US010982863B2

(12) United States Patent
Zaki et al.

(10) Patent No.: US 10,982,863 B2
(45) Date of Patent: Apr. 20, 2021

(54) HVAC FAN INLET

(71) Applicant: Carrier Corporation, Palm Beach Gardens, FL (US)

(72) Inventors: Mina Adel Zaki, Syracuse, NY (US); Ryan K. Dygert, Cicero, NY (US); Richie C. Stauter, Fayetteville, NY (US)

(73) Assignee: Carrier Corporation, Palm Beach Gardens, FL (US)

( * ) Notice: Subject to any disclaimer, the term of this patent is extended or adjusted under 35 U.S.C. 154(b) by 143 days.

(21) Appl. No.: 16/298,098

(22) Filed: Mar. 11, 2019

(65) Prior Publication Data

US 2019/0309963 A1 Oct. 10, 2019

Related U.S. Application Data

(60) Provisional application No. 62/655,411, filed on Apr. 10, 2018.

(51) Int. Cl.

| | |
|---|---|
| ***F24F 1/38*** | (2011.01) |
| ***F04D 29/54*** | (2006.01) |
| ***F04D 29/52*** | (2006.01) |
| *F04D 3/00* | (2006.01) |

(52) U.S. Cl.

CPC ..... *F24F 1/38* (2013.01); *F04D 29/522* (2013.01); *F04D 29/545* (2013.01); *F04D 29/547* (2013.01); *F04D 3/00* (2013.01); *F05D 2250/51* (2013.01)

(58) Field of Classification Search

CPC .. F24F 1/38; F24F 1/50; F04D 29/522; F04D 59/526; F04D 29/526; F04D 29/547

See application file for complete search history.

(56) References Cited

U.S. PATENT DOCUMENTS

| | | | |
|---|---|---|---|
| 3,306,179 | A | 2/1967 | Lambie et al. |
| 4,775,295 | A | 10/1988 | Starke et al. |
| 4,927,328 | A | 5/1990 | Scoates et al. |
| 7,086,825 | B2 | 8/2006 | Wang et al. |
| 8,961,124 | B2 | 2/2015 | Fukuda et al. |
| 9,822,801 | B2 | 11/2017 | Nakagawa et al. |

(Continued)

FOREIGN PATENT DOCUMENTS

| | | | |
|---|---|---|---|
| JP | 03168395 | A | 7/1991 |
| JP | 1068537 | A | 3/1998 |

(Continued)

OTHER PUBLICATIONS

25VNA8 Infinity® 18VS Variable Speed Heat Pump with Puron® Refrigerant, Product Data, Jan. 2015, Carrier Corporation, Indianapolis, IN.

(Continued)

*Primary Examiner* — Cassey D Bauer

(74) *Attorney, Agent, or Firm* — Bachman & LaPointe, P.C.

(57) ABSTRACT

A fan housing (184) is provided for accommodating a fan (154) rotating about a central axis (500). The fan housing comprises: an inlet (212); a diffuser (202); an inner diameter (ID) surface (200, 210) facing the central axis; and an outer diameter (OD) surface (240) facing away from the central axis. A rim (220) at the inlet has a plurality of apexes (231) and a plurality of nadirs (233).

22 Claims, 10 Drawing Sheets

(56) References Cited

U.S. PATENT DOCUMENTS

| | | | | |
|---|---|---|---|---|
| 2003/0217834 | A1* | 11/2003 | Campbell | F24F 1/027 165/47 |
| 2004/0201961 | A1 | 10/2004 | Ko et al. | |
| 2006/0024183 | A1 | 2/2006 | Lauzon | |
| 2006/0131101 | A1 | 6/2006 | Crocker | |
| 2008/0170935 | A1 | 7/2008 | Nakamura et al. | |
| 2010/0112929 | A1 | 5/2010 | Iantorno | |
| 2010/0269537 | A1 | 10/2010 | Tadokoro et al. | |
| 2011/0017427 | A1* | 1/2011 | Kato | F24F 1/38 165/59 |
| 2011/0217164 | A1 | 9/2011 | Coté | |
| 2014/0246180 | A1 | 9/2014 | Nakashima et al. | |
| 2014/0298844 | A1* | 10/2014 | Luo | F24F 1/18 62/275 |
| 2015/0140923 | A1* | 5/2015 | Penlesky | F24F 7/007 454/322 |
| 2016/0356288 | A1 | 12/2016 | Schrand | |
| 2017/0130975 | A1 | 5/2017 | Shoemaker et al. | |
| 2018/0224135 | A1 | 8/2018 | Yamamoto et al. | |

FOREIGN PATENT DOCUMENTS

| | | | |
|---|---|---|---|
| JP | 2006077585 | A | 3/2006 |
| JP | 2015036510 | A | 2/2015 |
| JP | 2017198389 | A | 11/2017 |
| JP | 2017223173 | A | 12/2017 |
| JP | 2017077576 | A1 | 6/2018 |
| WO | 2017/192647 | A1 | 11/2017 |

OTHER PUBLICATIONS

Indian Office Action dated Aug. 24, 2020 for Indian Patent Application No. 201914014150.

European Search Report dated Aug. 26, 2019 for European Patent Application No. 19167566.9.

Extended European Search Report dated Feb. 28, 2020 for European Patent Application No. 19211215.9.

* cited by examiner

HVAC FAN INLET

CROSS-REFERENCE TO RELATED APPLICATION

Benefit is claimed of U.S. Patent Application No. 62/655,411, filed Apr. 10, 2018, and entitled "HVAC Fan Inlet", the disclosure of which is incorporated by reference herein in its entirety as if set forth at length.

BACKGROUND

The disclosure relates to HVAC fan inlets. More particularly, the disclosure relates to fan inlets for HVAC fans receiving inlet flows that are not circumferentially uniform.

A typical residential climate control (air conditioning and/or heat pump) system has an outdoor unit including a compressor, a refrigerant-air heat exchanger (coil), and an electric fan for driving an air flow across the heat exchanger. The outdoor unit will often include an inverter for powering the compressor motor and/or fan motor.

In one basic outdoor unit configuration, the outdoor unit has a generally square footprint with the heat exchanger wrapping around four sides and three corners of that footprint between two headers. The compressor is positioned within a central cavity surrounded by the heat exchanger on a base of the unit. A service panel of the housing is mounted aligned with the gap and carries the inverter. The fan is mounted atop the outdoor unit and draws air inward through the heat exchanger to the central cavity and then exhausts it upward.

SUMMARY

One aspect of the disclosure involves a fan housing for accommodating a fan rotating about a central axis. The fan housing comprises: an inlet; a diffuser; an inner diameter (ID) surface facing the central axis; and an outer diameter (OD) surface facing away from the central axis. A rim at the inlet has a plurality of apexes and a plurality of nadirs.

In one or more embodiments of any of the foregoing embodiments, the housing has a mounting flange.

In one or more embodiments of any of the foregoing embodiments, the mounting flange has a generally rectangular planform and the nadirs are aligned with sides of the rectangle and the apexes are aligned with corners of the rectangle.

In one or more embodiments of any of the foregoing embodiments, the apexes are of protrusions along an underside of the mounting flange protruding downward and radially outward relative to the central axis.

In one or more embodiments of any of the foregoing embodiments, in central longitudinal section, the inner diameter surface and the outer diameter surface each have convex portions. At least at a given axial position, respective radial positions of the inner diameter surface and outer diameter surface convex portions vary in the circumferential direction around the central axis.

In one or more embodiments of any of the foregoing embodiments, the convex portions extend from the rim of the inlet.

In one or more embodiments of any of the foregoing embodiments, at at least one circumferential position, the outer diameter surface convex portion extends over a longitudinal span ($H_2$) of 5% to 40% of a throat diameter ($D_{THROAT}$) and a radial span ($R_S$) of 3% to 20% of $D_{THROAT}$.

In one or more embodiments of any of the foregoing embodiments, at the apexes, the radial span ($R_S$) is at least 200% of the radial span ($R_S$) at the nadirs.

In one or more embodiments of any of the foregoing embodiments, at the apexes, the radial span ($R_S$) is 200% to 1000% of the radial span ($R_S$) at the nadirs.

In one or more embodiments of any of the foregoing embodiments, the apexes are axially spaced from the nadirs by a height $H_1$ of at least 3% of a throat diameter ($D_{THROAT}$).

In one or more embodiments of any of the foregoing embodiments, the apexes are axially spaced from the nadirs by a height $H_1$ of 4% to 12% of the throat diameter ($D_{THROAT}$).

In one or more embodiments of any of the foregoing embodiments, the fan housing comprises a top cover mated to a lower member, the lower member being of molded plastic and including the mounting flange.

Another aspect of the disclosure involves a climate control outdoor unit comprising the fan housing and further comprising: a compressor having an electric motor; a refrigerant-air heat exchanger coupled to the compressor and extending around the central axis between a first header and a second header; and an electric fan encircled by the fan housing and positioned to drive an air flow along an air flowpath across the refrigerant-air heat exchanger then through the inlet and out the diffuser.

In one or more embodiments of any of the foregoing embodiments, the refrigerant air heat exchanger has a footprint with four sides and four corners, an inter-header gap at one of the four corners; the apexes are aligned with respective ones of the four corners; and the nadirs are aligned with respective ones of the four sides.

In one or more embodiments of any of the foregoing embodiments, the electric fan is atop the outdoor unit.

Another aspect of the disclosure involves a fan housing for accommodating a fan rotating about a central axis, the fan housing comprising: an inlet; a diffuser; an inner diameter (ID) surface facing the central axis; and an outer diameter (OD) surface facing away from the central axis. In central longitudinal section, the outer diameter surface has a convex portion. In said central longitudinal section, the inner diameter surface has a convex portion. At least at a given axial position, respective radial positions of the inner diameter surface and outer diameter surface convex portions vary in the circumferential direction around the central axis.

Another aspect of the disclosure involves a climate control outdoor unit comprising: a compressor having an electric motor; a refrigerant-air heat exchanger coupled to the compressor and extending around a central axis between a first header and a second header; a fan housing having a lower inlet and an upper diffuser; and an electric fan encircled by the fan housing and positioned to drive an air flow along an air flowpath across the refrigerant-air heat exchanger then through the inlet and out the diffuser. The fan duct inlet comprises means for limiting an inlet flow separation and reducing inflow non-uniformities about the central axis.

In one or more embodiments of any of the foregoing embodiments, the refrigerant air heat exchanger has a footprint with four sides and four corners, an inter-header gap at one of the four corners; the inlet has first portions aligned with the three remaining corners and second portions aligned with the four sides; and the first portions protrude axially beyond the second portions.

The details of one or more embodiments are set forth in the accompanying drawings and the description below.

Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

In this and other heating, ventilation, and air conditioning (HVAC) applications where a heat exchanger (coil) is upstream of the fan, the fan performance becomes highly dependent on the flow through the coil, the coil configuration, the coil characteristics, and the coil distance relative to the fan inlet. This generally results in a non-uniform acceleration of the inlet flow going into the fan and with the use of a planar fan inlet, this will lead to flow separation, increase of fan power, and increase of fan noise. A key example is the residential heat pump outdoor unit where the non-circular nature of the heat exchanger footprint imposes circumferential asymmetries on the inlet flow.

Figure 1:
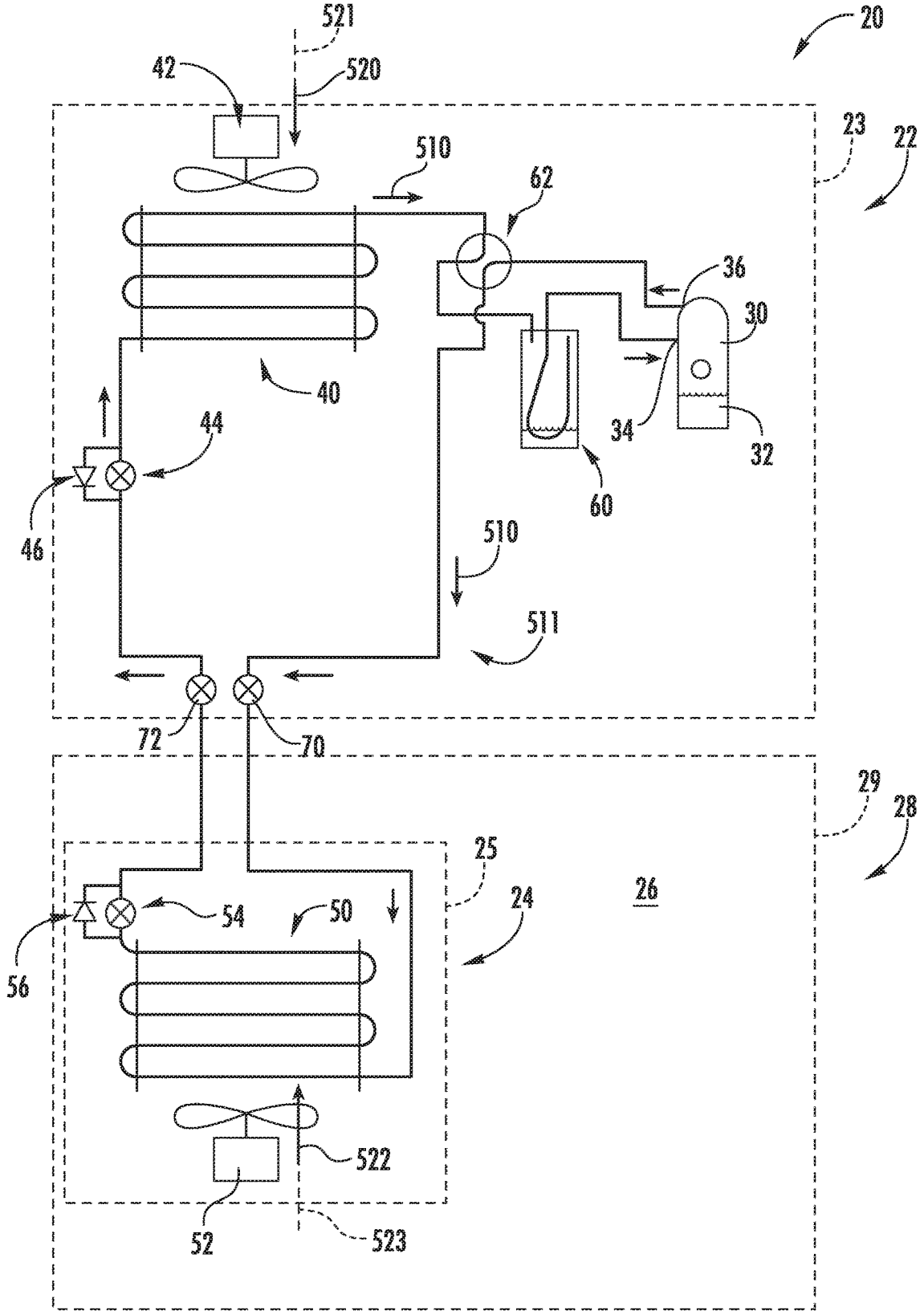
FIG. 1 PRIOR ART
FIG. 1 is a schematic view of a heat pump system in a heating mode.

FIG. 1 shows one example of an HVAC system 20 having an outdoor unit 22 (having a housing 23) and an indoor unit 24 (having a housing 25). The indoor unit 24 is within the interior 26 of a building 28. As is discussed further below, the exemplary outdoor unit 22 is a residential heat pump having both heating (FIG. 1) and cooling (FIG. 2) modes. The exemplary heat pump outdoor unit contains an electrically-powered compressor 30 having a motor 32. The compressor drives a refrigerant flow along a refrigerant flowpath entering the compressor at a suction port 34 and exiting the compressor at a discharge port 36. The various illustrated lines may be of conventional refrigerant line/conduit construction.

The outdoor unit has an outdoor heat exchanger 40 (e.g., a refrigerant-air heat exchanger) and an electric fan 42 for driving an air flow 520 along an air flowpath 521 across the outdoor heat exchanger. Similarly, the indoor unit has an indoor heat exchanger 50 (e.g., a refrigerant-air heat exchanger) and an electric fan 52 for driving an air flow 522 along an air flowpath 523 across the indoor heat exchanger. The exemplary flow 520 passes from an inlet of the housing 23 of the outdoor unit to an outlet of the housing. Similarly, the flow 522 may pass from an inlet of the indoor unit to an outlet of the indoor unit to return to the interior 26. Other more complex systems involving air exchange are possible. The exemplary outdoor unit further includes an expansion device 44 for use in the heating mode (e.g., a thermal expansion valve, electronic expansion valve, orifice, or the like). A check valve bypass 46 is provided to bypass the expansion device 44 in the cooling mode. Similarly, the indoor unit includes a heating mode expansion device 54 and a bypassing check valve 56.

The exemplary outdoor unit further includes an accumulator 60 and one or more switching valves for switching between the heating mode and the cooling mode. The exemplary illustrated switching valve is a four-way valve 62.

In the heating mode, a flow 510 of refrigerant is compressed by the compressor and passes along a refrigerant flowpath 511 from the discharge port through the exemplary switching valve 62 along a line (vapor line) passing out from the outdoor unit and entering the building to ultimately enter the indoor unit to feed the indoor heat exchanger 50. In this mode, the indoor heat exchanger 50 serves as a heat rejection heat exchanger rejecting heat to the air flow 522 (e.g., acting as a condenser or gas cooler). The cooled refrigerant flow then passes through the bypass 56 and back out of the indoor unit and building via a line (liquid line) to re-enter the outdoor unit. FIG. 1 shows an exemplary pair of service valves 70 and 72 in the outdoor unit allowing service thereof. After passing into the outdoor unit, the refrigerant proceeds through the expansion device 44 to the heat exchanger 40 which therefore serves conventionally as a heat absorption heat exchanger or evaporator absorbing heat from the air flow 520. The refrigerant then returns via the valve 62 and exemplary accumulator 60 to the suction port 34.

Figure 2:
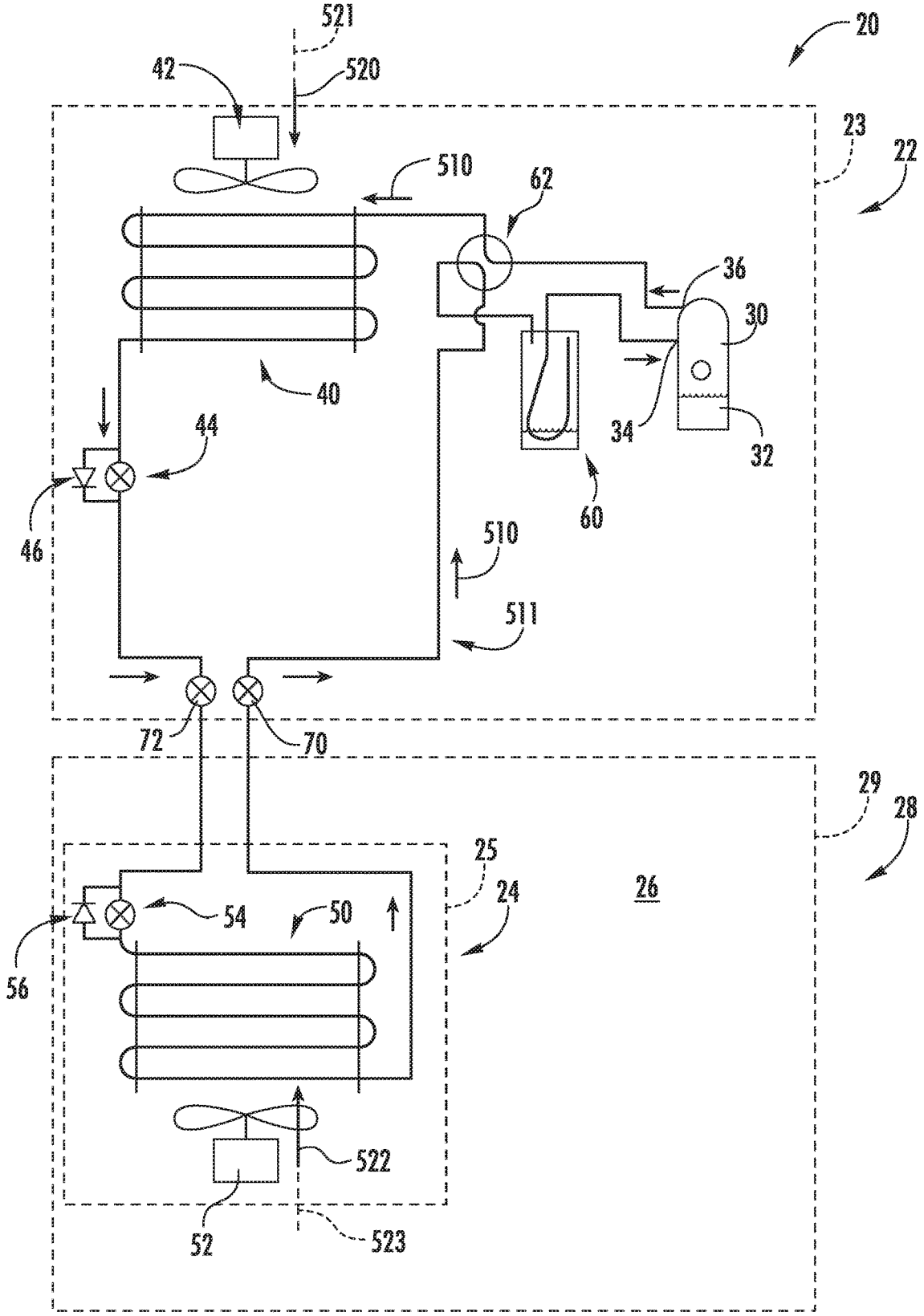
FIG. 2 PRIOR ART
FIG. 2 is a schematic view of the heat pump system in a cooling mode.

The FIG. 2 cooling mode generally reverses direction of flow through the heat exchangers with the compressed refrigerant passing initially to the outdoor heat exchanger, then through the bypass 46 and through the expansion device 54 and indoor heat exchanger 50 to ultimately return. Thus in the cooling mode, the outdoor heat exchanger serves as a heat rejection heat exchanger and the indoor heat exchanger serves as a heat absorption heat exchanger rejecting heat to and absorbing heat from their respective associated air flows.

As discussed further below, the exemplary compressor motor 32 is powered by an inverter. Inverter cooling is a critical factor in system operation.

Figure 3:
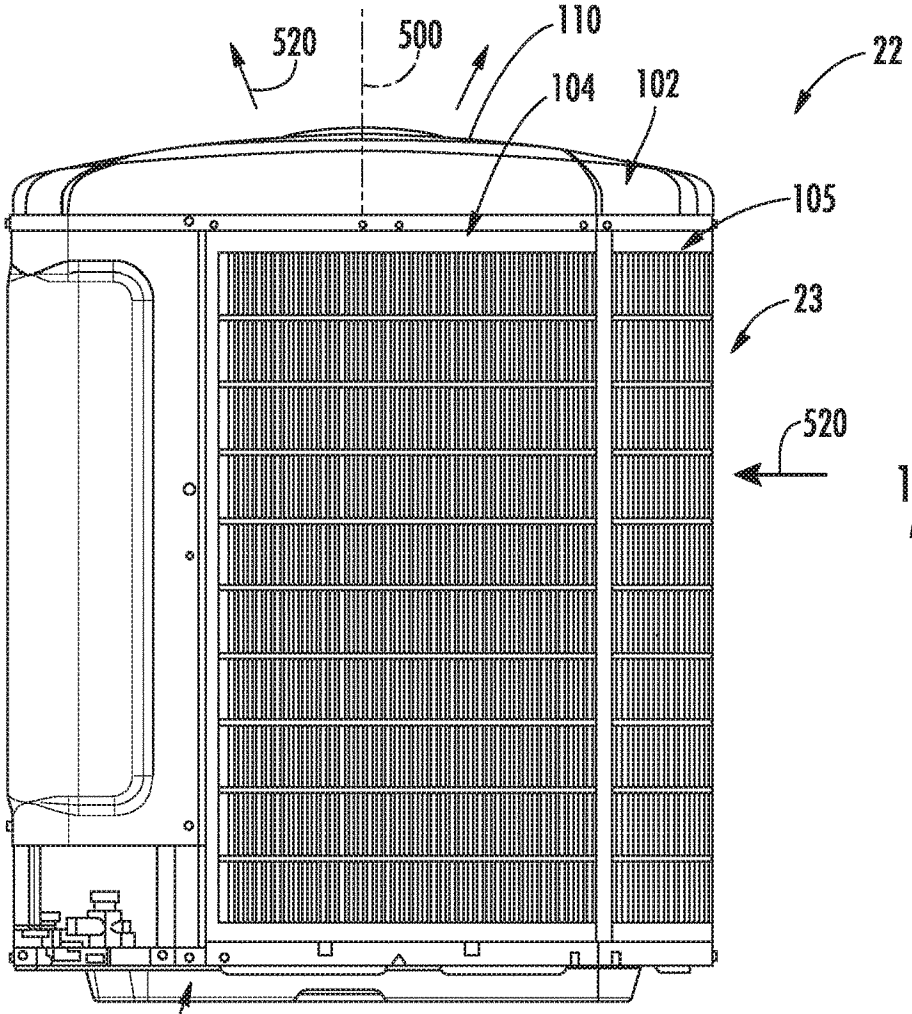
FIG. 3 PRIOR ART
FIG. 3 is a side view of an outdoor unit of the heat pump system.

FIG. 3 shows an exemplary outdoor unit 22. The outdoor unit has a base (base pan) 100 of generally square (e.g., with rounded or faceted corners) planform. The base pan supports the remainder of the outdoor unit components. Alternative coils can be of other planforms such as non-square rectangles or triangles of other polygons. Yet other coils may be oriented differently (e.g., V-coils where the shroud is above the V).

The base pan forms a portion of the housing 23. The housing extends upward to include a top cover 102. Along the lateral perimeter, one or more louver panels 104 and/or corner posts 105 (also shown louvered in the illustrated embodiment) or other structural members may connect the base pan to the top cover. The top cover may be an assembly carrying the fan 42 and integrated with a housing/shroud (discussed below) of said fan. The exemplary fan and its motor define a central vertical axis 500 shared with the remainder of the outdoor unit. At a top of the top cover, the top cover assembly may include a screen or fan guard 110.

The louver openings form an air inlet along the outdoor unit air flowpath and the top cover fan guard openings form an air outlet.

Figure 4:
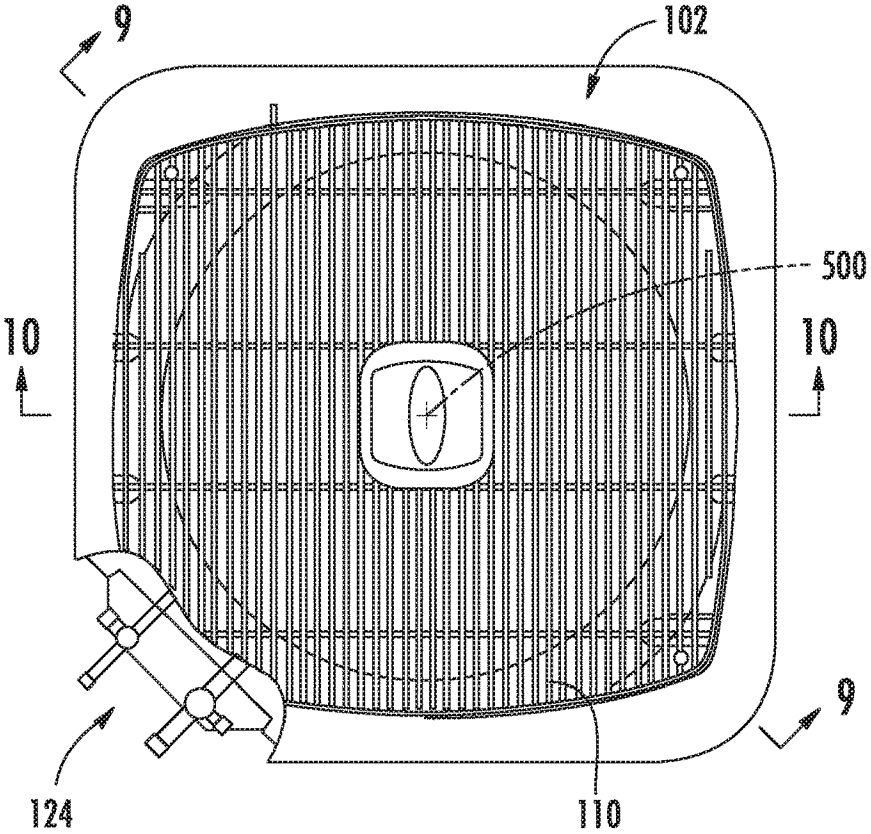
FIG. 4 PRIOR ART
FIG. 4 is a partially cutaway top view of the outdoor unit.
Figure 5:
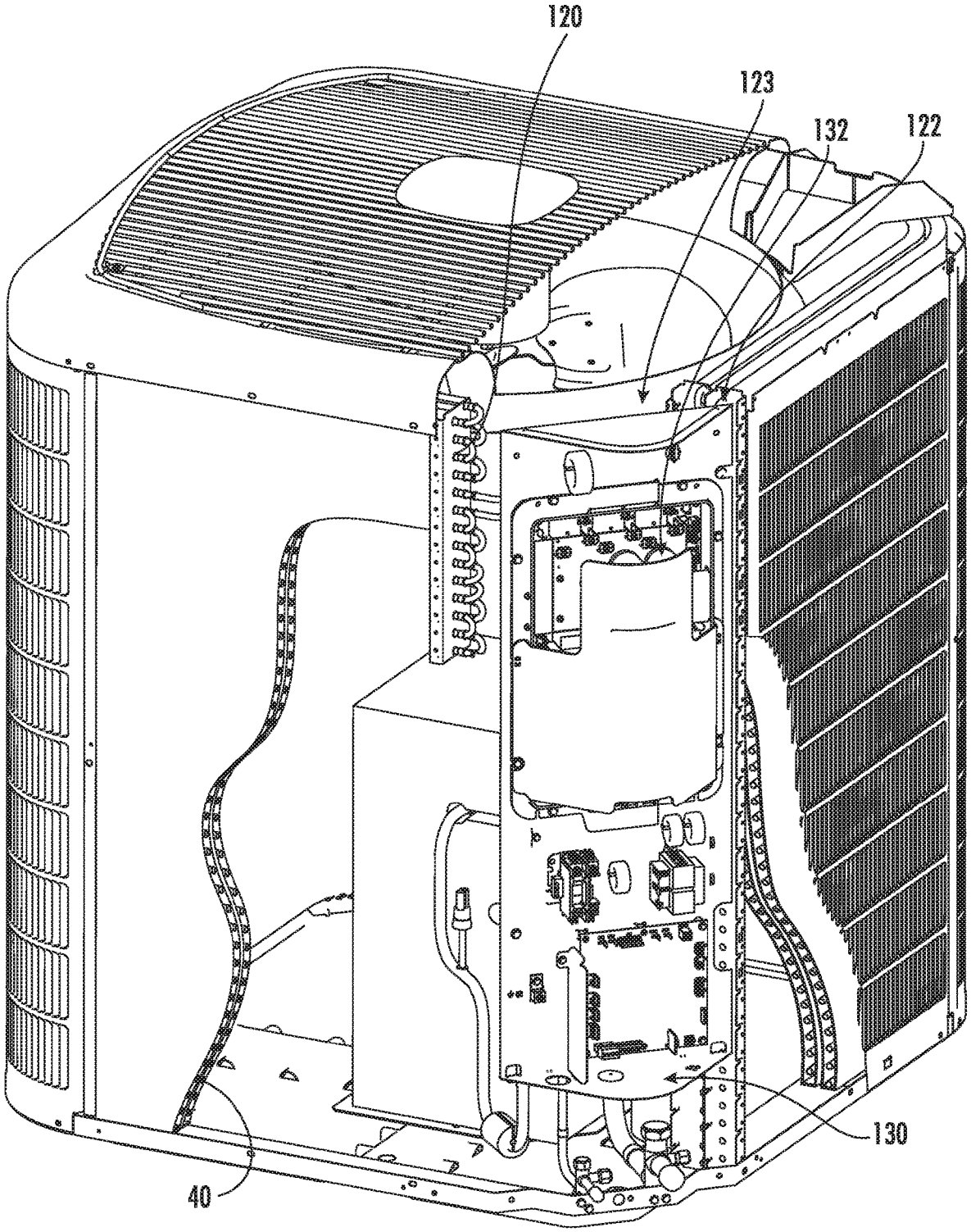
FIG. 5 PRIOR ART
FIG. 5 is a partially cutaway view of the outdoor unit.

The exemplary outdoor heat exchanger 40 comprises a tube array wrapping generally around four sides and three corners of the footprint of the outdoor unit between a first header 120 and a second header 122 (shown in FIG. 5). A gap 123 between the two headers is aligned generally with one corner 124 (FIG. 4, shown with top cover 102 and fan guard 110 locally cut-away) of the footprint of the outdoor unit. A control box 130 (FIG. 5) may be vertically mounted along this corner and contain the compressor motor control/inverter unit 132 and other associated components. The compressor (not shown) may be located centrally surrounded by the outdoor heat exchanger supported atop the base pan. Exemplary input power is single phase AC (e.g., nominal 220V, 60 $H_2$). Exemplary output of the inverter unit is three-phase AC (e.g., varying in voltage, current, and frequency). Inverter power is typically limited by current and inverter temperature.

Figure 6:
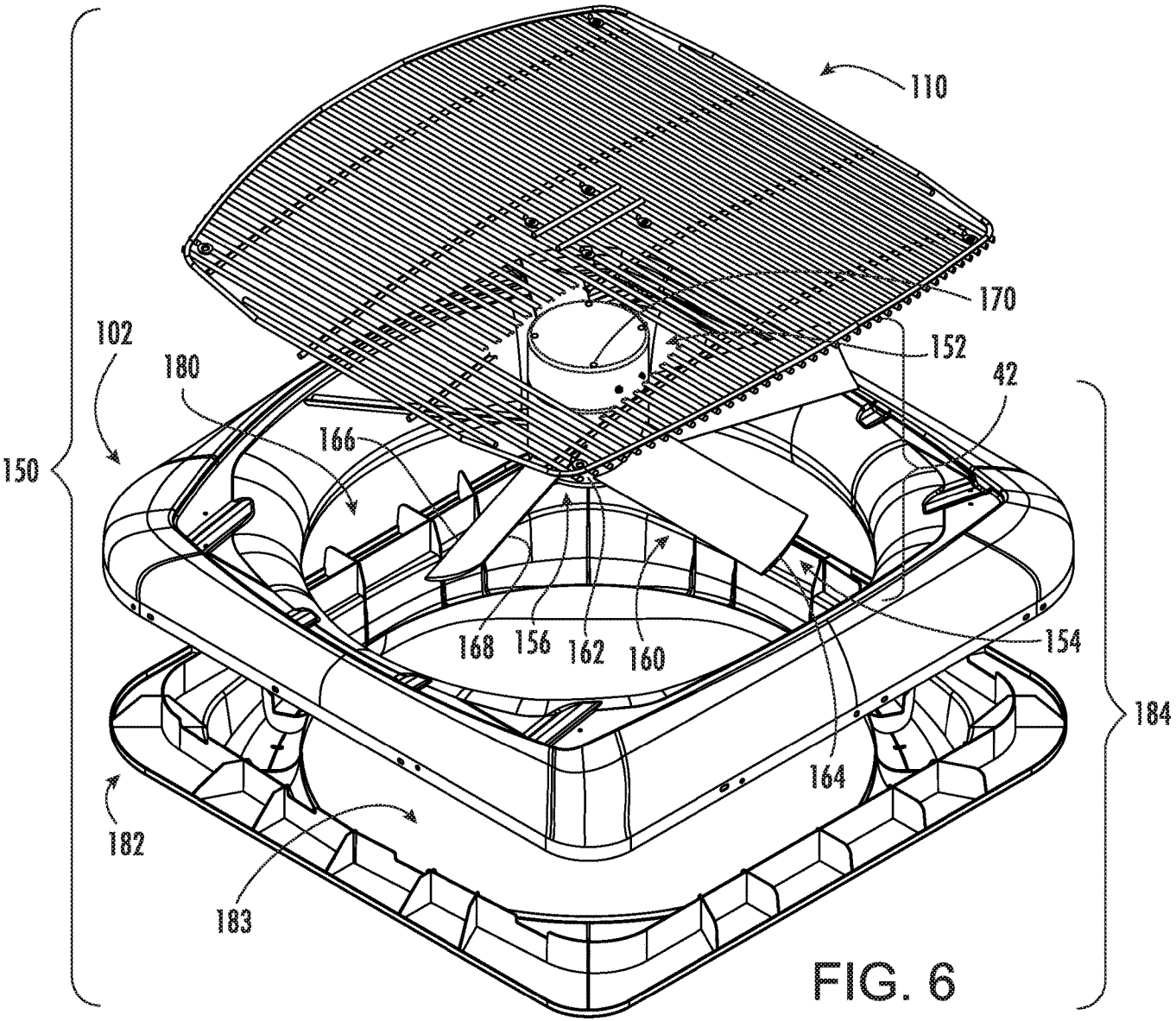
FIG. 6 is a vertically exploded view of a fan duct and fan assembly of the outdoor unit.
Figure 7:
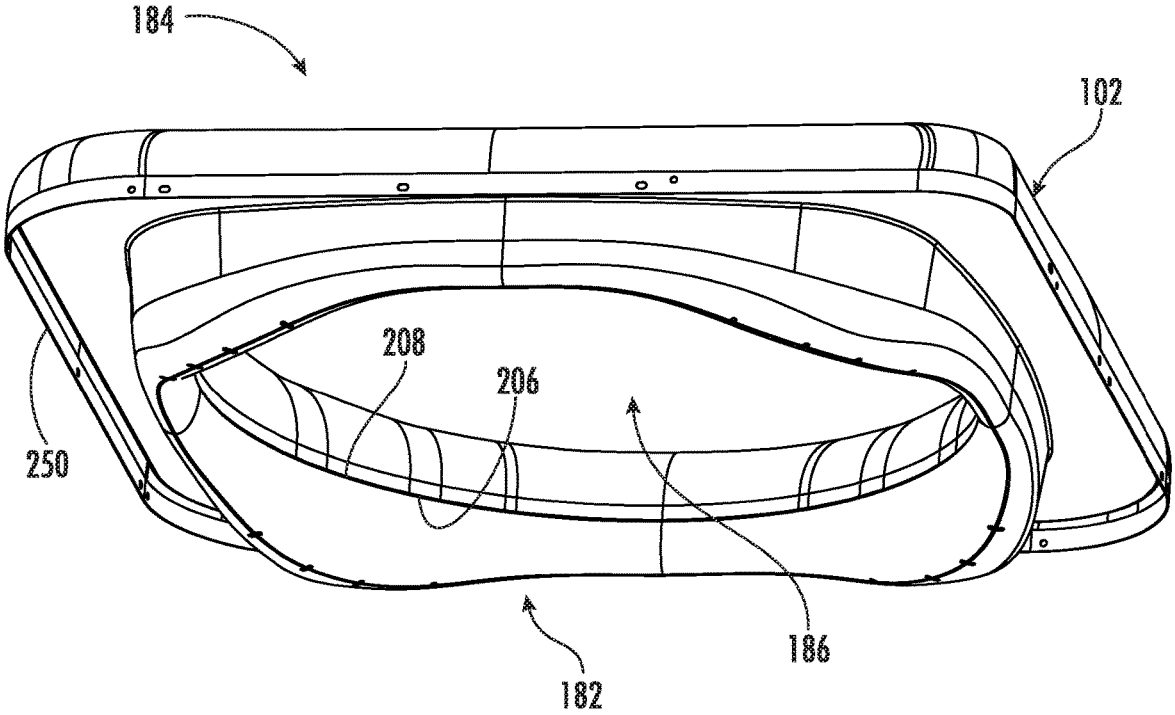
FIG. 7 is an isolated view of the fan duct.

FIG. 6 shows an assembly 150 including the fan 42. The fan has an electric motor 152 and a bladed impeller 154. The exemplary impeller 154 is a sheet metal structure or a molded polymeric structure having a hub 156 with a socket 158 keyed for mounting to a rotor shaft of the motor. A plurality of blades 160 extend radially outward from a peripheral sidewall 162 of the hub to associated distal ends or tips 164. This is distinguished from an impeller having an outer diameter (OD) shroud integral with the blades. However shrouded impellers may alternatively be used. The blades have respective leading edges 166 and trailing edges 168. The motor case may comprise one or more mounting holes 170 for mounting the motor. Exemplary mounting may be via screwing to the fan guard 110 or to a framework (not shown) mounted across an upper end of an opening 180 through the top cover. As noted above, the exemplary top cover 102 combines with a lower member 182 having an opening 183 to define a fan housing 184 (aka, fan shroud or unit outlet duct) surrounding the fan impeller. FIG. 7 shows the assembled top cover 102 and lower member 182 forming an outlet duct 184 with a vertical passage 186 therethrough.

Figure 9:
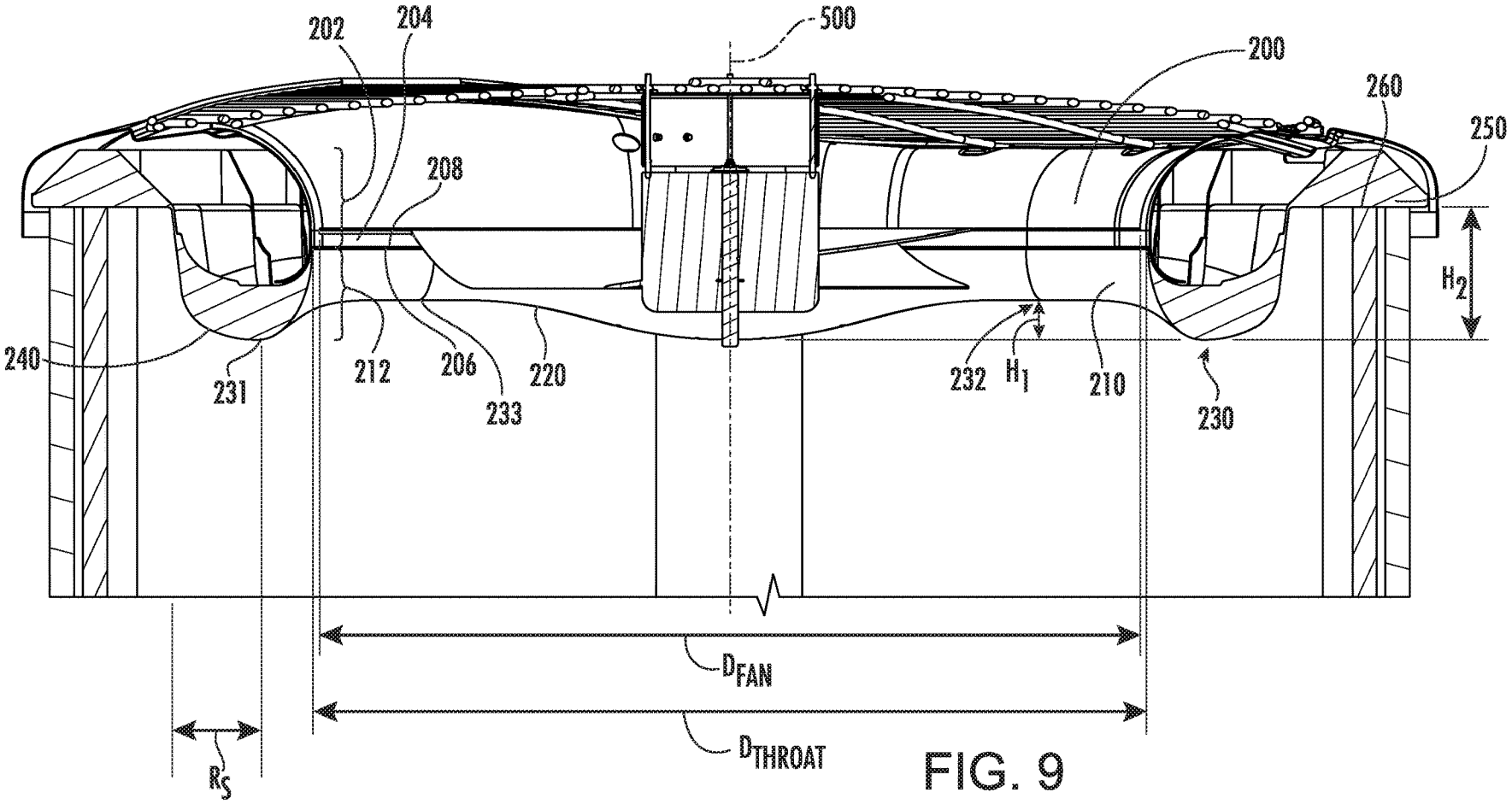
FIG. 9 is a first partially schematic partial sectional view of an upper portion of the outdoor unit taken along line 9-9 of FIG. 4.

FIG. 9 shows the top cover inboard or inner diameter (ID) surface 200 having a downstream divergent shape to serve as a diffuser 202. In the exemplary embodiment, a minimum ID location or throat 204 on the outlet duct is proximate a junction between the top cover ID surface 200 and the ID surface 210 of the member 182. The junction may be formed by abutting top cover lower rim 206 and member 182 upper rim 208. However, this does not have to be the case and, as is discussed below, even in other such two-piece duct combinations the boundary can be along one or the other of the two pieces. And, additionally, combinations of more pieces are possible and single-piece ducts are also possible.

However, in this exemplary implementation, the member 182 forms an inlet 212 (upstream of the throat) for the fan with a generally downstream convergent surface extending from a lower extremity 220.

Figure 10:
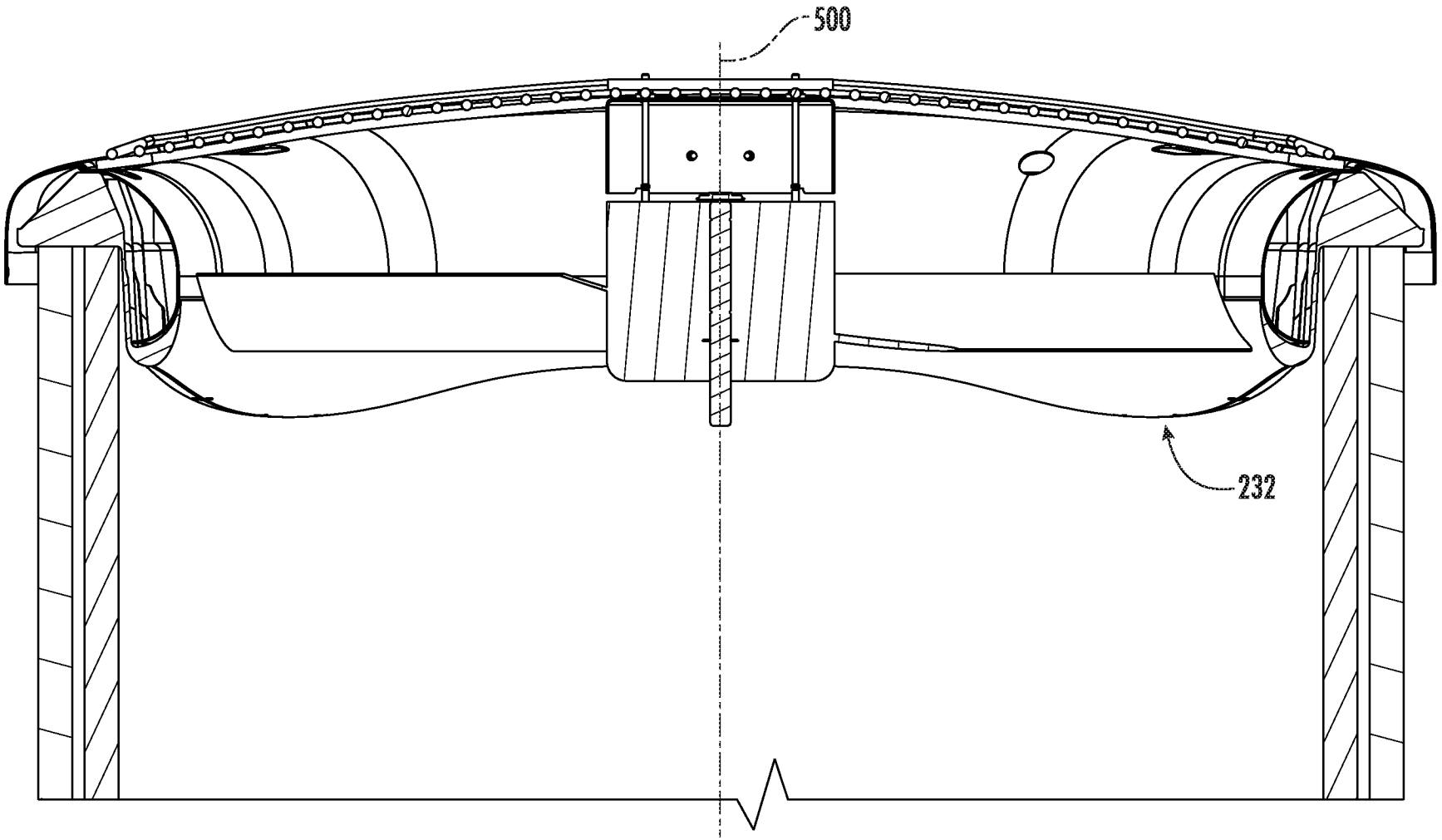
FIG. 10 is a second partially schematic partial vertical sectional view of the outdoor unit taken along line 10-10 of FIG. 4.

FIG. 9 is a partially schematic partial sectional view of an upper portion of the outdoor unit taken along line 9-9 of FIG. 4 which is a diagonal of the footprint cutting across two corners of the heat exchanger. FIG. 10 is a partially schematic partial vertical sectional view of the outdoor unit taken along line 10-10 of FIG. 4 which is across two sides of the footprint cutting across two sides or legs of the heat exchanger footprint.

Comparing FIGS. 9 and 10, it is seen that the member 182 (more particularly, whatever element forms the duct inlet) is not rotationally symmetric about the axis 500 but rather has four circumferentially spaced axially protruding portions (protrusions or lobes) 230 (FIG. 9) (forming peaks having associated apexes 231 along the rim 220) circumferentially interspaced with four troughs 232 (forming valleys having associated nadirs 233 along the rim 220). The apexes and nadirs are defined in the frame of reference of the shroud itself and its lower member 182 so as to be independent of orientation of the shroud. Thus, in the exemplary outdoor unit the apexes are low points in an observer's frame of reference.

As is discussed further below, the protrusions or lobes/apexes are circumferentially aligned with the corners of the heat exchanger footprint and the troughs/nadirs are aligned with the sides.

Figure 8:
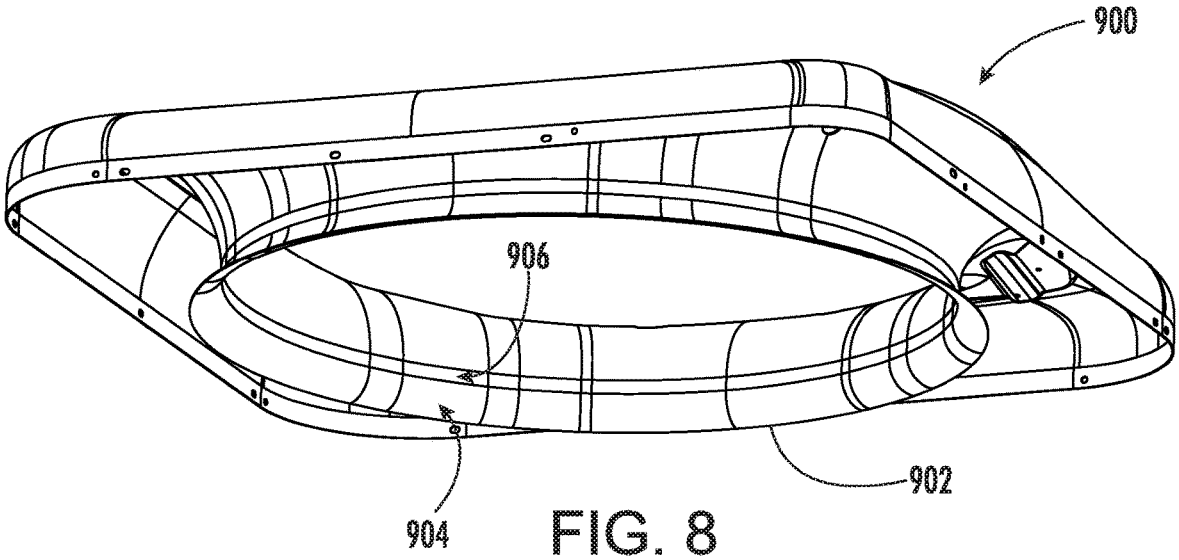
FIG. 8 PRIOR ART
FIG. 8 is an isolated view of a prior art duct.

FIG. 8 shows a prior art or baseline top cover 900. The exemplary top cover 900 is formed as a metallic sheet metal stamping. Thus, it has an essentially constant wall thickness. The exemplary top cover 900 entirely defines the associated fan outlet duct. Accordingly, a lower rim 902 forms a duct inlet. Progressing downstream from the inlet 902, an inwardly convex portion 904 (FIG. 11) extends to a throat 906 whereafter a diffuser 908 extends further downstream to a rim 910. The diffuser may be generally similar to that provided by the top cover 102. With such a duct inlet, has been observed that having the rounded cornered square footprint heat exchanger imposes inlet flow asymmetries which interfere with desired airflow through the duct.

Figure 11:
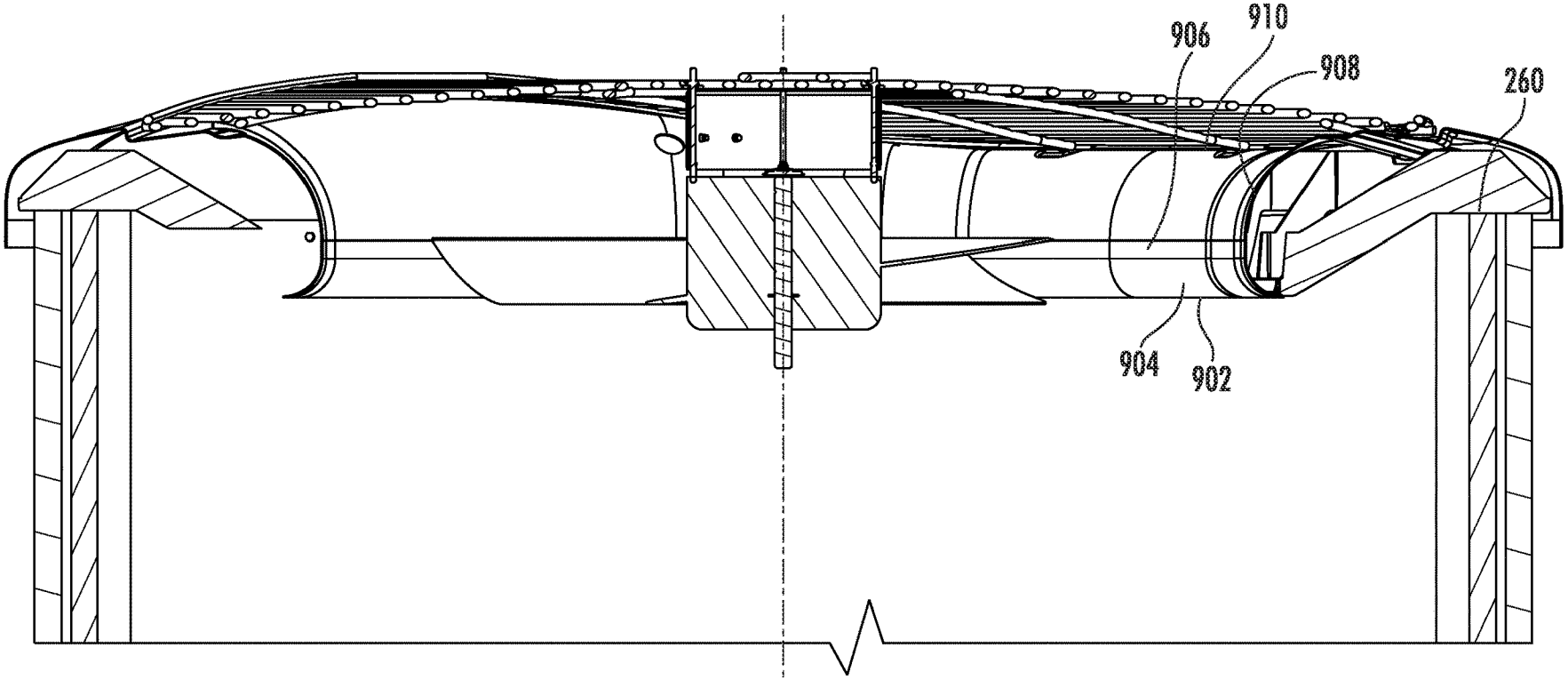
FIG. 11 PRIOR ART
FIG. 11 is a partially schematic partial vertical sectional view of a prior art outdoor unit.
Figure 12:
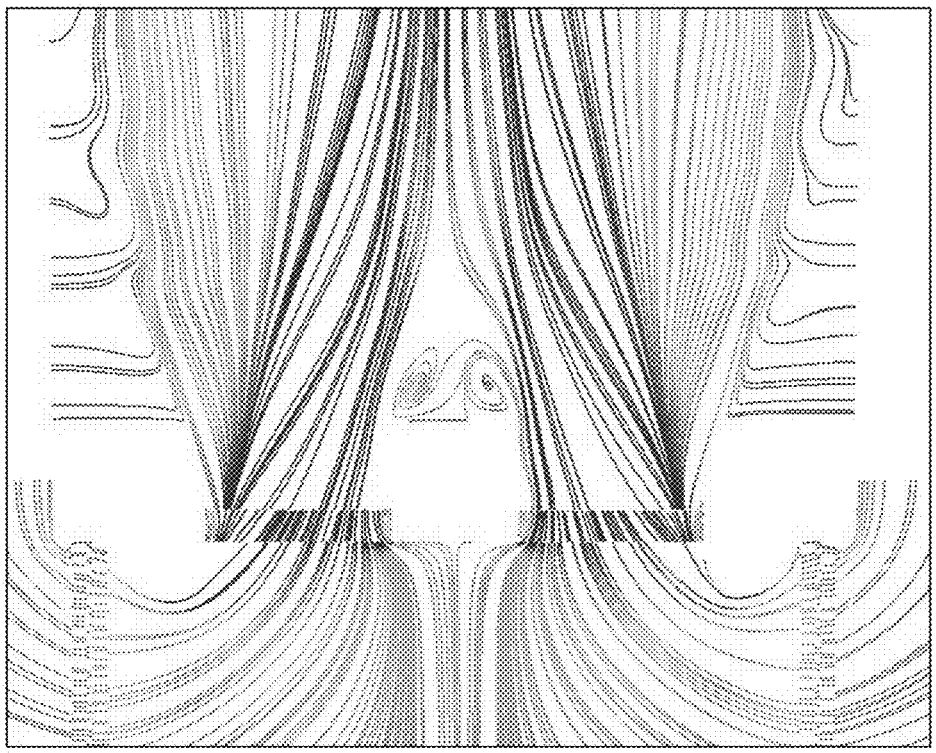
FIG. 12 is flow model for the FIG. 9 cross-section.
Figure 13:
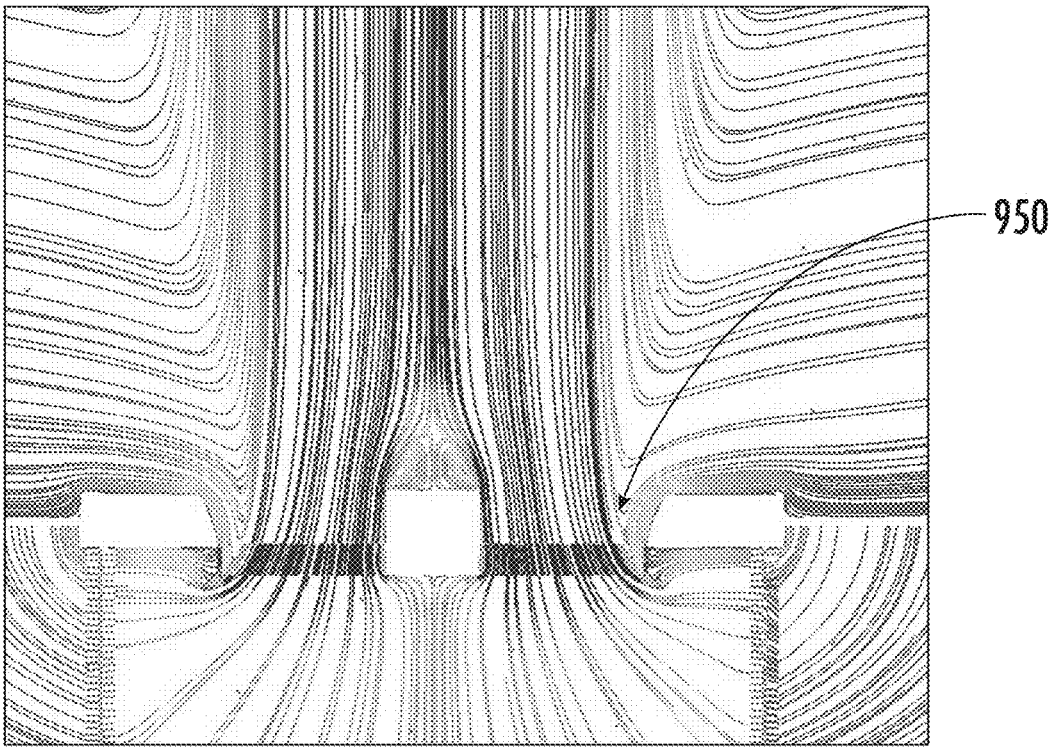
FIG. 13 PRIOR ART
FIG. 13 is a flow model for the FIG. 11 cross-section.

In the exemplary illustrated FIGS. 9 and 10 embodiment and corresponding FIG. 11 prior art, the upper edge 260 of the heat exchanger is above the level of the inlet. Additionally, there are asymmetries from having a greater distance between the fan and the heat exchanger near the corners of the footprint than near the sides. With such a system, FIG. 13 shows the effect of a separation bubble 950 forming in the duct adjacent the corners of the footprint. The separation bubble starts well upstream of the blades. As each blade circumferentially spins and encounters the separation bubble, the blade experiences changes in flow conditions and thus experiences a cyclic input. The result is potentially a further loss of efficiency and the associated generation of sound. As is discussed further below, the presence of the lobes and troughs helps circumferentially even out the flow to reduce or eliminate the separation bubble. This may maximize flow while minimizing noise and energy loss.

As noted above, a first aspect of the modified inlet is the asymmetry. A second aspect is replacing the single layered sheet metal construction with one that spaces an outboard (outer diameter (OD)) surface 240 (FIG. 9) of the member 182 away from the inboard surface. In vertical section, this presents a smooth radially and axially outwardly convex surface from an underside of a mounting flange 250 to the lower extremity or rim 220 whereafter the smooth transition continues through the radially inwardly and axially outwardly convex ID surface 210. FIG. 9 shows fan diameter $D_{FAN}$ at blade tips just inside of the throat diameter $D_{THROAT}$. A height $H_1$ is shown between the extremities of the lower rim. A height (vertical span) of the outboard convexity is shown as $H_2$. A radial span of the outboard convexity is shown as $R_S$. An exemplary $H_1$ is at least 3% of $D_{THROAT}$, more particularly, 3% to 20% or 4% to 12%. Exemplary $H_2$ at the apexes and nadirs is at least as large as $H_1$. For example, exemplary $H_2$ is at least 5% of $D_{THROAT}$, more particularly, 5% to 40% or 10% to 30%. Technically, the troughs might go to the flange underside so that $H_2$ is locally zero.

An exemplary $R_S$ at the apexes is at least 5% of $D_{THROAT}$, more particularly, 6% to 25% or 6% to 15%. An exemplary $R_S$ at the nadirs is at least 1% of $D_{THROAT}$, more particularly, 1% to 10% or 2% to 6%. In some embodiments, $R_S$ at the apexes may be at least 200% $R_S$ at the nadirs, or 200% to 1000% or 250% to 1000%. Technically $R_S$ at the nadirs could go to zero when the troughs might go to the flange.

The lobed inlet structure may be adopted as a retrofit of an existing unit having an existing top cover 900. In some variations on such a situation, the existing top cover may be preserved/maintained and the added lower member 182 may mate with the top cover 900 to downwardly extend the resulting outlet duct below the rim 902 and define both the protuberant structure generally (e.g., shifting airflow away from the outer surface of the sheet metal) and defining the particular discrete protrusions/lobes. Thus, in an example of that, the existing top cover may define the inlet ID surface until the lower rim 902 of the top cover. The ID surface of the lower member may this continue the inlet ID surface downward/upstream to the lower/upstream rim 220 and thereafter form the OD surface, all continuing the longitudinal convexity. However, whereas the inlet ID surface portion along the top cover may be rotationally symmetric, along the lower member as one approaches the rim 220 the ID surface will become rotationally asymmetric to define ID surface portions of the lobes or protrusions 230. Thus, due to such asymmetry, at least at a given axial position shy of the rim 220, respective radial positions of the ID surface and OD surface convex portions may vary in the circumferential direction around the central axis 500.

Environmental exposure factors may lead to stamped sheet metal (e.g., steel or aluminum alloy) for the top cover 102. This may be made via existing techniques for top covers. The lower member may be a molded plastic material. This can be a relatively structural molding (e.g., injection molded) with reinforcing webs/ribs. Or it may be a thin wall structure such as a blow molding or sheet thermoforming. Yet further variations include forming the lower member of expanded bead material (e.g., expanded polypropylene (EPP)) or foams. Alternatively, a sheet metal stamping could be used for the lower member.

A design process may configure the outlet duct (mainly the inlet thereof) to control/precondition/redistribute the coil outlet flow going into the fan circumferentially/radially/axially to achieve fan power reduction and/or fan noise reduction. This is done by varying the inlet configuration cross-section circumferentially around the fan going from the fan-coil pinch point section (the smallest fan-coil proximity) to the fan-coil corner section (the largest fan-coil proximity). The particular variation may be optimized via computational fluid dynamics (CFD) or physical iteration. The cross-sections of the lobed fan inlet at the fan-coil corner and fan-coil pinch point are shown in the figures. It can be seen how the lobed fan inlet is characterized by a unique wavy shape around the fan circumferential, where the lobed inlet section is deepest inside the coil at the corner sections and is shallowest at the pinch point sections. This lobed or wavy shape allows the inlet to control the flow acceleration accordingly as it varies around the fan circumference.

In various implementations, the lobed fan inlet may control the inlet flow acceleration and eliminate or reduce inlet flow separation and reduce inflow non-uniformities. This may enable better fan performance, thereby reducing the fan power. The lobed fan inlet may also redistribute the inlet flow more uniformly around the fan circumference thereby reducing the inlet flow non-uniformity going into the fan and reducing the fan noise levels. The lobed fan inlet may thus reduce the fan power and the fan noise levels.

Although illustrated in the context of a residential outdoor unit, other situations are possible. One example is a commercial HVAC unit where the fan is above a V-coil in a rectangular HVAC duct. Often, there are two fans along a V-coil and thus both may have such a lobed inlet.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A fan housing (184) for accommodating a fan (154) rotating about a central axis (500), the fan housing comprising:

an inlet (212);

a diffuser (202);

an inner diameter (ID) surface (200, 210) facing the central axis; and an outer diameter (OD) surface (240) facing away from the central axis, wherein:

a rim (220) at the inlet has a plurality of apexes (231) and a plurality of nadirs (233);

the fan housing comprises a top cover mated to a lower member, the lower member being of molded plastic; and the fan housing further comprises a separate grille secured to the top cover.

2. The fan housing of claim 1 wherein:

the housing has a mounting flange (250).

3. The fan housing of claim 2 wherein:

the mounting flange has a generally rectangular planform; and the nadirs are aligned with sides of the rectangle and the apexes are aligned with corners of the rectangle.

4. The fan housing of claim 2 wherein:

the apexes are of protrusions along an underside of the mounting flange protruding downward and radially outward relative to the central axis.

5. The fan housing of claim 2 wherein:

in central longitudinal section, at a given axial position, the inner diameter surface and the outer diameter surface each have convex portions; and at least at said given axial position, respective radial positions of the inner diameter surface and outer diameter surface convex portions vary in the circumferential direction around the central axis.

6. The fan housing of claim 5 wherein:

the convex portions extend from the rim (220) of the inlet.

7. The fan housing of claim 6 wherein at at least one circumferential position:

the outer diameter surface convex portion extends over a longitudinal span ($H_2$) of 5% to 40% of a throat diameter ($D_{THROAT}$) and a radial span ($R_S$) of 3% to 20% of $D_{THROAT}$.

8. The fan housing of claim 7 wherein:

at the apexes, the radial span ($R_S$) is at least 200% of the radial span ($R_S$) at the nadirs.

9. The fan housing of claim 7 wherein:

at the apexes, the radial span ($R_S$) is 200% to 1000% of the radial span ($R_S$) at the nadirs.

10. The fan housing of claim 9 wherein:

the apexes are axially spaced from the nadirs by a height $H_1$ of at least 3% of a throat diameter ($D_{THROAT}$).

11. The fan housing of claim 1 wherein:

the apexes are axially spaced from the nadirs by a height $H_1$ of 4% to 12% of the throat diameter ($D_{THROAT}$).

12. The fan housing of claim 1 wherein:

the lower member includes a mounting flange.

13. A climate control outdoor unit (22) comprising the fan housing of claim 1 and further comprising:

a compressor (30) having an electric motor (32);

a refrigerant-air heat exchanger (40) coupled to the compressor and extending around the central axis between a first header (120) and a second header (122); and an electric fan (42) encircled by the fan housing and positioned to drive an air flow (520) along an air flowpath (521) across the refrigerant-air heat exchanger then through the inlet and out the diffuser.

14. The climate control outdoor unit of claim 13 wherein:

the refrigerant air heat exchanger has a footprint with four sides and four corners, an inter-header gap (123) at one of the four corners;

the apexes (231) are aligned with respective ones of the four corners; and the nadirs (233) are aligned with respective ones of the four sides.

15. The climate control outdoor unit of claim 13 wherein:

the electric fan is atop the outdoor unit.

16. The climate control outdoor unit of claim 13 wherein:

the top cover is sheet metal.

17. The climate control outdoor unit of claim 16 wherein:

the apexes and nadirs are along the lower member.

18. A fan housing (184) for accommodating a fan (154) rotating about a central axis (500), the fan housing comprising:

an inlet (212);

a diffuser (202);

an inner diameter (ID) surface (200, 210) facing the central axis; and an outer diameter (OD) surface (240) facing away from the central axis, wherein:

in central longitudinal section, the outer diameter surface has a convex portion;

in said central longitudinal section, the inner diameter surface has a convex portion; and at least at a given axial position, respective radial positions of the inner diameter surface and outer diameter surface convex portions vary in the circumferential direction around the central axis.

19. A climate control outdoor unit (22) comprising the fan housing of claim 18 and further comprising:

a compressor (30) having an electric motor (32);

a refrigerant-air heat exchanger (40) coupled to the compressor and extending around a central axis between a first header (120) and a second header (122);

an electric fan (42) encircled by the fan housing and positioned to drive an air flow (520) along an air flowpath (521) across the refrigerant-air heat exchanger then through the inlet and out the diffuser.

20. The climate control outdoor unit of claim 19 wherein:

the refrigerant air heat exchanger has a footprint with four sides and four corners, an inter-header gap at one of the four corners;

the inlet has first portions (230) aligned with the three remaining corners and second portions (232) aligned with the four sides; and the first portions protrude axially beyond the second portions.

21. The fan housing of claim 18 wherein:

the inner diameter surface convex portion is partially along a sheet metal top cover of the fan housing and partially along a molded plastic lower member of the fan housing; and the outer diameter surface convex portion is along the molded plastic lower member of the fan housing.

22. A fan housing (184) for accommodating a fan (154) rotating about a central axis (500), the fan housing comprising:

an inlet (212);

a diffuser (202);

an inner diameter (ID) surface (200, 210) facing the central axis; and an outer diameter (OD) surface (240) facing away from the central axis, wherein:

a rim (220) at the inlet has a plurality of apexes (231) and a plurality of nadirs (233);

the fan housing comprises a sheet metal top cover mated to a molded plastic lower member; and the apexes and nadirs are along the lower member.

* * * * *